US005964671A

United States Patent [19]

Edwards et al.

[11] Patent Number: 5,964,671

[45] Date of Patent: Oct. 12, 1999

[54] VARIABLE WEIGHT ASSEMBLY FOR RACKET

[76] Inventors: Brian D Edwards, 2744 Sprague Dr., Waldorf, Md. 20601; Larry D Edwards, 7530 Brentland Rd., Welcome, Md. 20693

[21] Appl. No.: 09/114,316

[22] Filed: Jul. 13, 1998

[51] Int. Cl.[6] ..... A63B 69/38

[52] U.S. Cl. ..... 473/437; 473/459; 473/422; 473/553

[58] Field of Search ..... 473/463, 459, 473/519, 522, 422, 437, 553, 461, 464, 494; 273/DIG. 20

[56] References Cited

U.S. PATENT DOCUMENTS

| | | | |
|---|---|---|---|
| 2,932,514 | 4/1960 | Bergmark | 473/553 |
| 2,975,547 | 3/1961 | Greve | 473/594 X |
| 3,330,560 | 7/1967 | Higdon . | |
| 3,716,239 | 2/1973 | Goudreau . | |
| 3,913,911 | 10/1975 | Peterson . | |
| 3,971,559 | 7/1976 | DiForte, Jr. . | |
| 4,000,893 | 1/1977 | Evans . | |
| 4,005,864 | 2/1977 | Stewart . | |
| 4,052,061 | 10/1977 | Stewart . | |
| 4,063,730 | 12/1977 | Bates | 473/437 |
| 4,076,239 | 2/1978 | Hall | 473/437 |
| 4,108,433 | 8/1978 | Althoff . | |
| 4,142,721 | 3/1979 | Faleck et al. . | |
| 4,200,285 | 4/1980 | Petitti, Jr. . | |
| 4,249,728 | 2/1981 | Bratt . | |
| 4,355,803 | 10/1982 | Rama . | |
| 4,538,812 | 9/1985 | Mugford et al. . | |
| 4,671,510 | 6/1987 | Schoenwetter . | |
| 4,697,811 | 10/1987 | Muroi . | |
| 5,039,097 | 8/1991 | Bartlett . | |
| 5,054,780 | 10/1991 | Chen . | |
| 5,083,777 | 1/1992 | Held . | |
| 5,284,343 | 2/1994 | Bigornia et al. | 473/588 X |
| 5,286,021 | 2/1994 | Shaw . | |
| 5,409,217 | 4/1995 | Bobby | 473/437 X |
| 5,593,155 | 1/1997 | Fauble et al. . | |

OTHER PUBLICATIONS

Franklin weight, "The Sporting Goods Dealer", p. 146. copy in cl. 473/FOR.115, May 1975.

Swing Master, "Tennis", p. 88. copy in cl. 473/FOR. 115, Dec. 1979.

*Primary Examiner*—Raleigh W. Chiu

*Attorney, Agent, or Firm*—Sixbey, Friedman, Leedom & Ferguson, P.C.; Tim L. Brackett, Jr.

[57] ABSTRACT

A warm-up and weight training device for use on a sports racket is provided which can be readily secured to and removed from the racket's strings. The device includes two housing portions and a plurality of weights positionable in the housing portions. A securing device is used to clamp the housing portions together from opposing sides of the strings while securing the housing and weights to the strings. Protective gaskets are provided as a barrier preventing injury to the strings. The combination of the variable weights and the change in the moment arm based on the position of the invention from the handle, provide a wide range of resistance.

18 Claims, 3 Drawing Sheets

VARIABLE WEIGHT ASSEMBLY FOR RACKET

BACKGROUND

1. Field of Invention

This invention is one of the class of athletic training devices designed to be connected to and thereby add weight to a hand held device for striking a ball, and especially for use in association with a tennis racket for the purpose of developing the strength and dexterity of a tennis player.

2. Description of Prior Art

The present invention generally relates to sports and, more particularly, to a device for warming-up and training for racket sports such as tennis, squash, racketball, and badminton. Warming-up and weight training safely and effectively enhance racket sport performance. Typically, tennis players warm-up by practicing their strokes—forehand, backhand, service, and overhead-before participation in competition. Practice strokes tend to increase blood flow to the necessary muscles in the shoulder and arm therefore increasing freedom of movement and flexibility, while decreasing susceptibility to muscle strain or similar injuries. With respect to weight training, development of hand, wrist, forearm, and shoulder strength prepares a player to withstand the stresses required of his body during racket sport competition. The invention described herein, heightens the beneficial effects just described.

In connection with warming-up and training for athletic events, prior art devices are known which attach weights to a racket or bat. These devices increase the load or resistance on the active muscle ultimately increasing the strength and flexibility of that muscle. For instance, a player can practice with the weighted device whereby he trains the muscles to endure a heavier load. Upon removing the added weight the player will experience an increase in speed and power. Such devices can also be used for muscle conditioning and development. It is known that repeating a prescribed motion develops muscle coordination and efficiency. Increasing the load on the muscle during such activity further enhances the effects of conditioning the muscle.

In such sports as baseball and golf it has been desirable in the past to use weighted attachments which directly connect to the baseball bat or golf club.

For example, U.S. Pat. No. 3,971,559 relates to a circular weight attachment known as a "batting doughnut." It is intended to be placed around the circumference of a baseball bat such that when a player repeatedly swings the bat, muscles in his arms and shoulders are stretched while developing strength.

A similar device has been devised for golf clubs as shown in U.S. Pat. No. 3,716,239. This patent discloses a weighted device which attaches to the base of a golf club immediately adjacent to the club head. By repeatedly swinging a golf club having this weighted attachment, the player stretches and strengthens the particular muscles associated with controlling the golf swing.

In connection with warming-up and weight training for racket sports, several devices have also been developed.

U.S. Pat. No. 3,330,560 to Higdon discloses a tennis racket weight attachment. It is a flexible sheet of material capable of holding, on its inside surface, and added weight. This device is attached to the top of the head of a tennis racket by tying it on with a lace or string.

U.S. Pat. No. 4,000,893 to Evans discloses a tennis racket weight holder. This device is made of a flexible material, having two inner pockets for added weights. The device can be attached to the throat of the racket by overlapping the ends of the material which have Velcro, or some other method of attachment at those ends.

U.S. Pat. No. 4,052,061 to Stewart discloses a racket weighting means. This device wraps around the throat of a tennis racket and secures itself by Velcro or other similar attachment means.

U.S. Pat. No. 4,142,721 to Faleck et al. discloses a weight and belt assembly. This weighted device secures to the throat of a tennis racket by passing a flexible belt through the parallel slots of a weighted plate and which is then secured with the use of Velcro or the like.

U.S. Pat. No. 4,200,285 to Petitti, Jr. discloses a racket weight system where tubular shaped members are constructed such that they can be attached to a tennis racket along the side-portions of the head or hitting surface area.

U.S. Pat. No. 4,538,812 to Mugford discloses a weight device for athletic rackets. This device is made of two sheets separated by an elastic member. Each sheet contains a number of weights, which are housed in chambers. This device can be attached to the throat of a tennis racket and secured with Velcro.

U.S. Pat. No. 4,249,728 to Bratt discloses a tennis racket exercise weight assembly. The assembly consists of opposing weights arranged on opposite sides of the interwoven strings and secured in a clamping engagement by a quick release attachment. The weights are not variable requiring a second weight assembly to change the amount of weight. The device does not have a means of protecting the strings by using a threaded stud and thus the weights spin and rub against the strings as they are threaded on thereby undesirably inflicting damage.

U.S. Pat. No. 4,671,510 to Schoenwetter discloses a weighted racket cover. The devise consists of a cover with a means for holding weights. The weights are suspended above the racket strings causing them to bang against racket strings while in use.

U.S. Pat. No. 5,083,777 to Held discloses a conditioning aid for racket sports. The device is an elongate elastomeric weighted rib that engages on the periphery of a racket frame containing integral elongate locking elements which are releasably interlocked immediately below the frame and between the strings. Alternatively, the weighted ribs may be mounted to the opposed sides of the racket in alignment with the "sweet spot". This devise is difficult to adhere to the racket as the locking elements are interlocked between the closely strung strings.

U.S. Pat. No. 5,286,021 to Shaw discloses a racket sport warm-up and weight training device. The device is comprised of a housing which fits around the lower end of the head of the racket, elongated members within the housing which are resiliently biased against the frame thereby securing the device, supplemental weights, and weight retaining clips for securing the weights within the said housing. This device provides varying resistances only by the same increments as those of the weights.

Some of the above mentioned devices are connected to the throat area of the racket without means for preventing them from slipping down the throat onto the handle of the racket or onto the hand of the person holding the racket. This creates a potentially injurious circumstance to the party swinging the racket whose hand would encounter the fall of the weighted device.

A further problem with some of the above-mentioned devices is that tennis rackets come in a variety of different sizes, shapes, and widths. Some of the devices described above cannot adapt to fit a wide range of racket sizes and shapes.

For the above reasons, it would be particularly advantageous to develop a racket warm-up and weight training device that is securely fastened to the racket regardless of size or shape. The device should be fully adjustable for use by players of all capabilities and strengths. The device should not damage the racket to which it is attached. The device should provide a quick means for attaching and removing from racket.

SUMMARY OF THE INVENTION

The present invention provides a racket sport warm-up and weight training device that adjusts fully, does not injure the racket or strings, and has a quick means for securing and removing from the racket's strings.

Accordingly, several objects and advantages of present invention are:

(a) to provide a warm-up and weight training device which is fully weight adjustable.

(b) to provide a warm-up and weight training device which fastens securely to any strung racket regardless of type, size, or shape.

(c) to provide a warm-up and weight training device which does not cause injury to the racket.

(d) to provide a warm-up and weight training device which quickly attaches and removes from racket.

Further objects and advantages of present invention will become apparent from a consideration of the drawings and ensuing description.

DETAILED DESCRIPTION OF THE INVENTION

The device embodied by this invention can be constructed in different sizes to accommodate the different sizes of rackets associated with each racket sport. The present device will be described herein with respect to a tennis racket only as an example of one type of racket sports which will benefit from the present invention.

Figure 1:
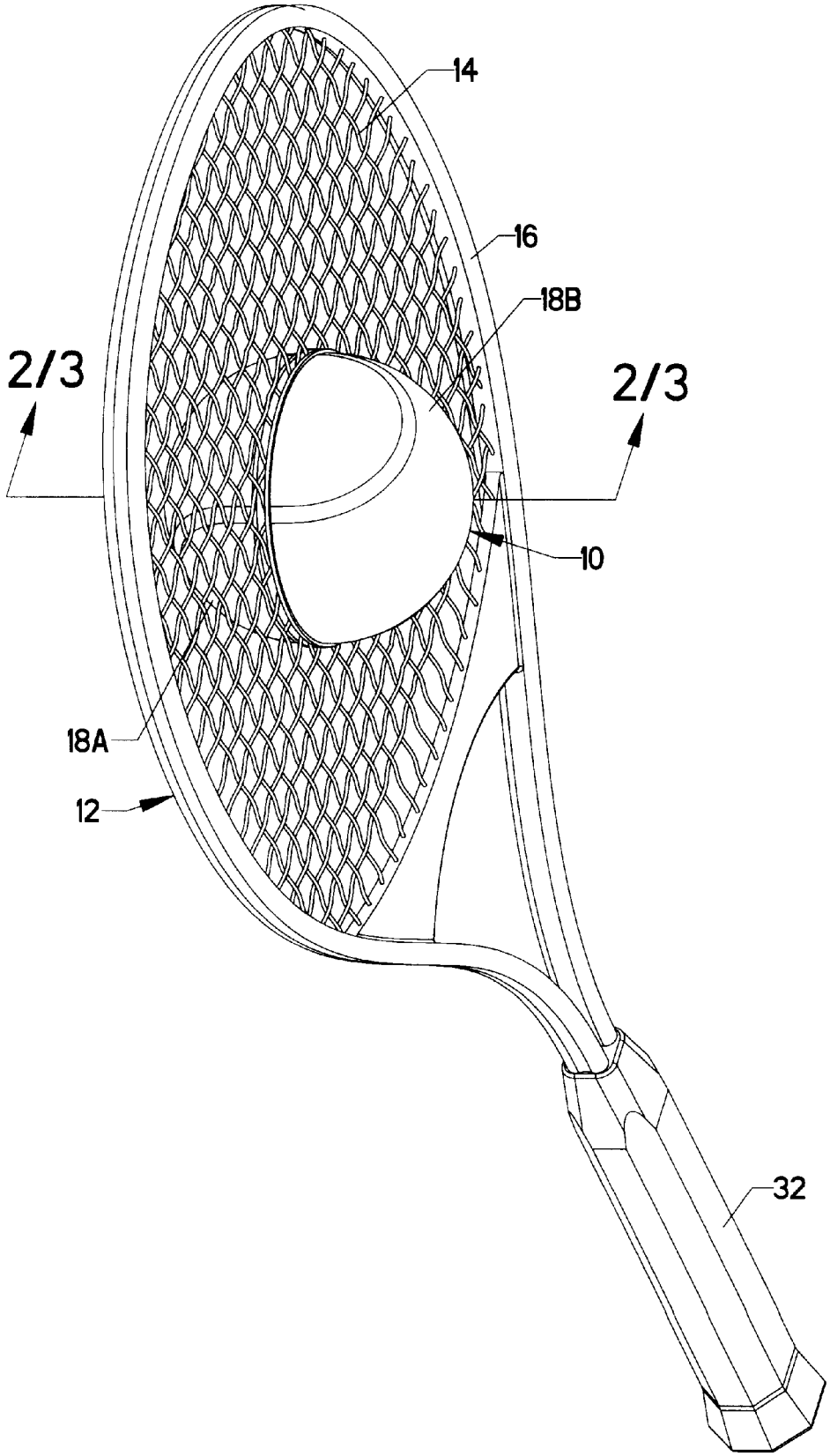
FIG. 1 is an isometric view of the warm-up and weight training device of the present invention secured to a sports racket.

FIG. 1 is an isometric view of a warm-up and weight training device 10 secured to a sports racket 12. Device 10 can be placed anywhere on a mesh of interwoven strings 14 as long as it does not interfere with a racket frame 16. The device comprises a housing including a first housing portion 18A and a second housing portion 18B made of high-impact plastic or of other suitable material. The housing illustrated has a spherical shape with stripes like those of a tennis ball (although not necessary for proper use). First and second housing portions 18A, 18B form a housing cavity 21 sized to receive a plurality of weights as discussed more fully hereinbelow.

Figure 2:
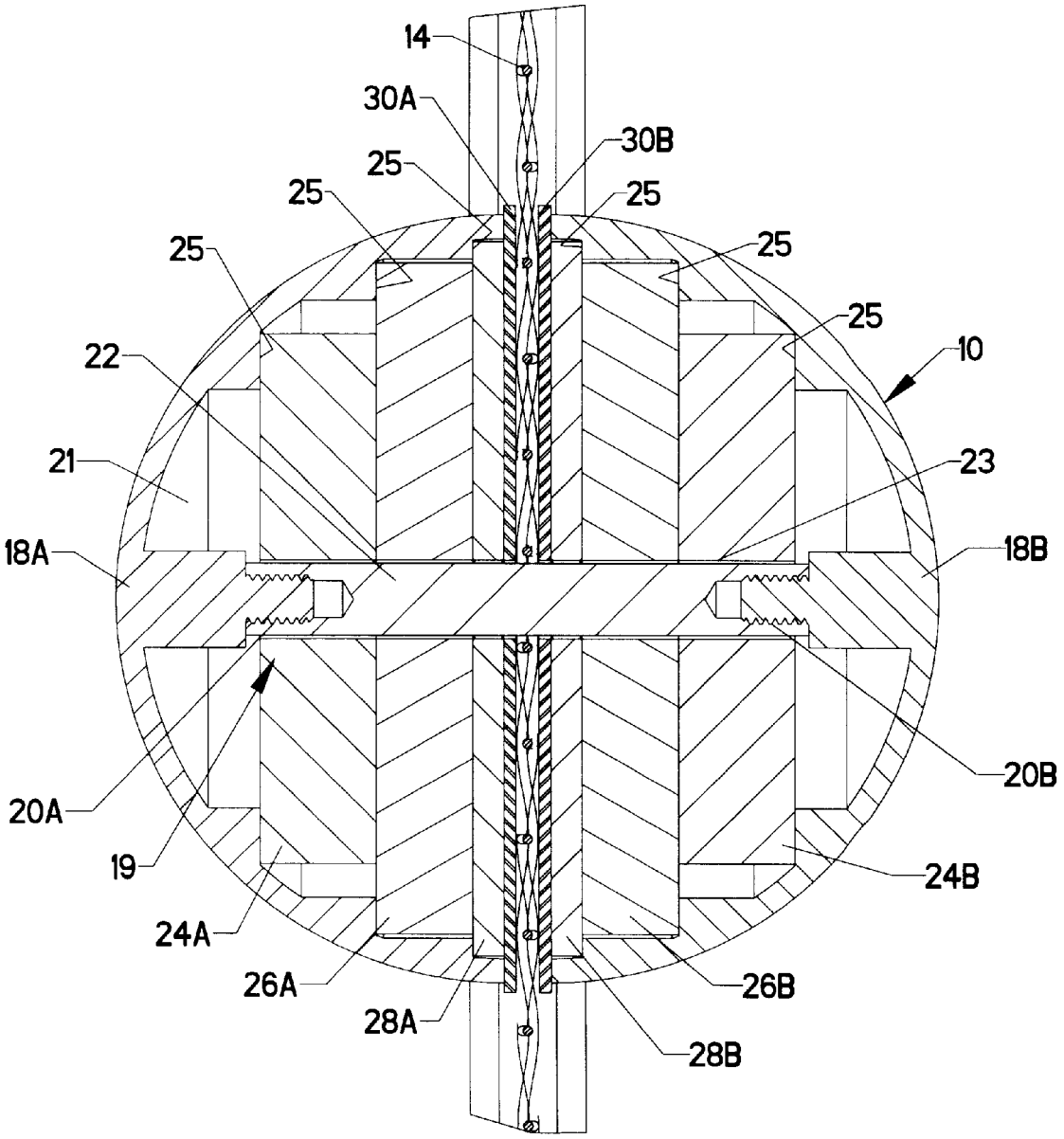
FIG. 2 is a partial sectional view of the warm-up and weight training device of FIG. I secured to a sports racket.

FIG. 2 is a partial sectional view of the warm-up and weight training device 10 secured to a sports racket. A securing device, indicated generally at 19, is provided for securing first housing portion 18A to second housing portion 18B. Securing device 19 fundamentally includes a threaded connection between the first and second housing portions 18A, 18B. Specifically, in the present embodiment, securing device 19 includes a standoff 22 and a threaded connection 20B. A threaded connection 20A is provided to connect first housing portion 18A to standoff 22. The standoff 22 is made of metal or other suitable material. The standoff 22 is threaded on each end to connect to first housing portion 18A and second housing portion 18B. Standoff 22 can be permanently attached to first housing portion 18A with adhesive or other suitable means. Alternatively, standoff 22 may be formed integrally with one housing portion. The standoff is smooth on the exterior preventing injury to strings 14. The assembly further includes a plurality of weights 24A, 24B, 26A, 26B, 28A and 28B. Securing device 19 also includes an aperture 23 extending through each of the weights for receiving standoff 22. The weight 24A slides on standoff 22 into cavities of first housing portion 18A followed by the weight 26A and the weight 28A. Securing device 19 also includes a plurality of lands 25 formed on the interior of first and second housing portions 18A, 18B for abutment against the weights. A gasket 30A slides on standoff 22. Racket 12 slides on standoff 22 through the strings 14 and resides against the gasket 30A. A gasket 30B slides on standoff 22 followed by a weight 28B then a weight 26B, and a weight 24B. The gaskets 30A and 30B are made of a neoprene rubber or any other suitable material. The gaskets 30A and 30B prevent injury to the strings 14. Second housing portion 18B connects to standoff 22 with the threaded connection 20B. When second housing portion 18B is connected to the standoff 22, the gaskets 30A and 30B clamp against the strings 14 securing the device 10. Upon assembly, securing device 19 effectively applies a securing force to the weights so as to both secure the weights in housing cavity 21 while securing the housing and the weights to strings 14. The gaskets 30A and 30B are illustrated as separate parts but could be incorporated into the first and second housing portions 18A and 18B or some or all of weights 24A, 24B, 26A, 26B, 28A, and 28B. . The weights 24A, 24B, 26A, 26B, 28A, and 28B are made of iron or of any suitable material and can be constructed in different sizes and shapes. There can be more or less weights incorporated in the device and they can slide on standoff or simply be placed in housing. Threaded connection 20B is illustrated as the release attachment means, however, any other suitable release attachment means can be used.

Figure 3:
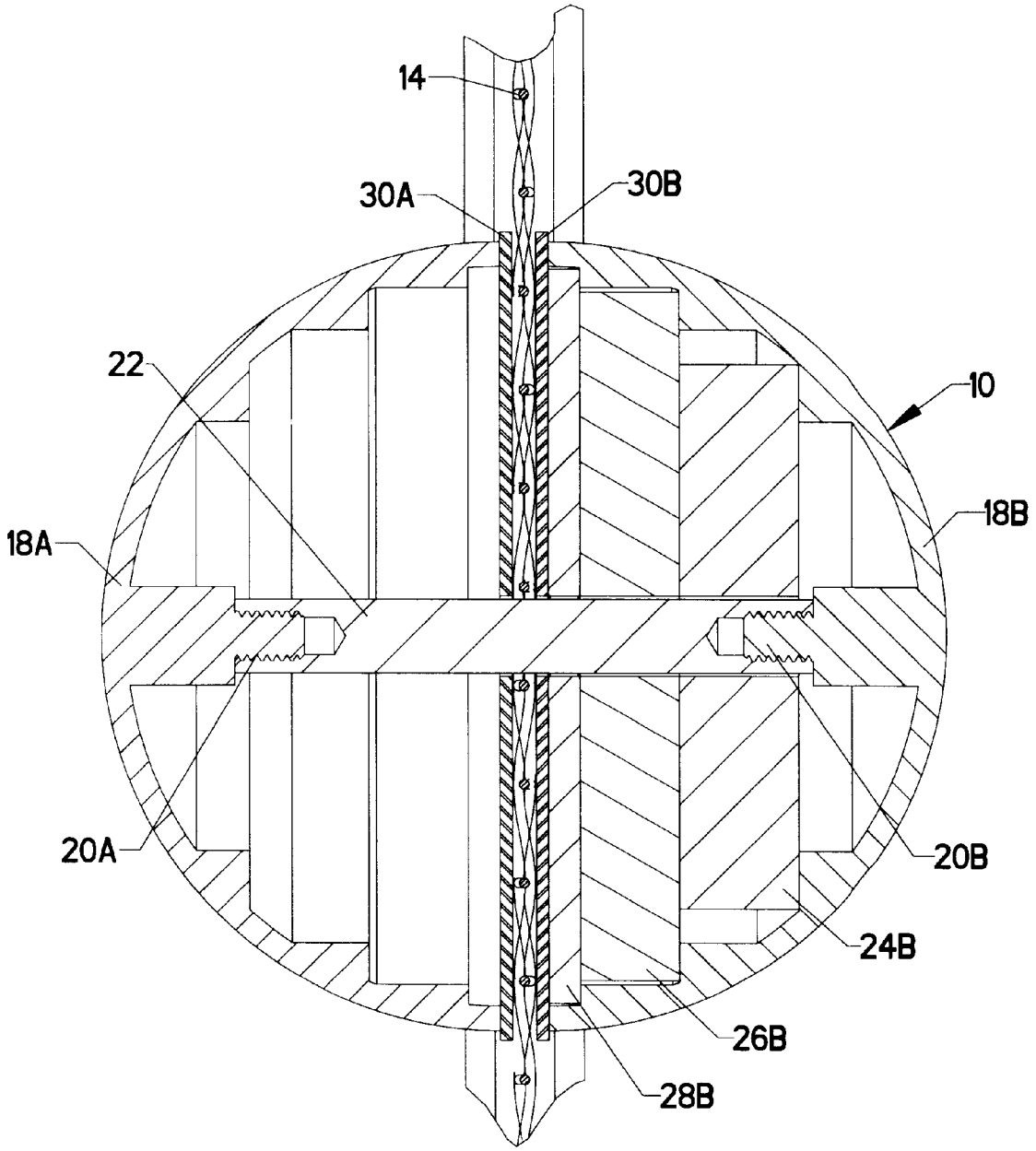
FIG. 3 is a partial sectional view of the warm-up and weight training device of FIG. I secured to a sports racket without all of the weights.

In FIG. 3, the warm-up and weight training device 10 is shown without weights 24A, 26A, and 28A. This demonstrates the ability to place variable weights into the warm-up and weight training device 10.

In use, a player uses the warm-up and weight training device 10 assembled to a racket 12 in FIG. 1 to perform exercises to improve the strength and control of the muscles used to swing a racket or to limber up before play.

The warm-up and weight training device 10 is assembled to the strings 14 as shown in FIG. 2. Standoff 22 threads into first housing portion 18A with thread connection 20A. Weights 24A, 26A, and 28A slide on standoff and into first housing portion 18A. Gasket 30A slides on standoff. Standoff 22 passes through strings 14 in chosen position. Gasket 30B slides on standoff 22 followed by weights 28B, 26B, and 24B. Second housing portion 18B connects to standoff 22 with threaded connection 20B. When second housing portion 18B is connected to the standoff 22, the gaskets 30A and 30B clamp against the strings 14 securing the device 10.

When assembled, gaskets 30A and 30B remain still against the strings while the second housing portion 18B turns against the gasket 30B. Some or all of weights 24A, 24B, 26A, 26B, 28A, and 28B may be left out to attain less resistance.

The location of the warm-up and weight training device 10 may be shifted closer or farther from a handle 32, shown in FIG. 1, along the central axis of the head portion of the tennis racket to change the moment arm varying the overall resistance to a player. Moreover, when a player is having difficulty positioning the racket 12 properly angularly about its longitudinal axis during any type of stroke, the exercise weight assembly may also be positioned laterally relative to the longitudinal axis of the racket by an amount sufficient to produce a suitable corrective torque about the longitudinal axis during each stroke.

Having the above in mind, a user, coach or trainer can select the weight that is appropriate for merely loosening muscles and joints, for manipulation of the racket to practice and perfect certain basic strokes, or for strenuous dynamic muscular activity that is ultimately productive of increased racket speed and ball impacting force.

From the description above, a number of advantages of the warm-up and weight training device become evident:

(a) The housing provides cavities that some, none, or many weights are secured providing a weight adjustable racket sport warm-up and weight training device.

(b) The standoff in combination with the housing and gasket clamp securely onto the strings providing a means to attach to any strung racket regardless of type, size, or shape.

(c) Along with the capability to place different amounts of weight securely in the housing, the invention can also be placed at different lengths from player's grip varying the resistance by changing the length of the moment arm.

(d) The gasket prevents any twisting or rubbing of parts along strings. The gasket remains still against the strings while the housing turns against the gasket. Portion of standoff that is between strings has no sharp edges.

(e) The threaded standoff provides a quick means for attaching and removing from racket.

Accordingly, the reader will see that the warm-up and weight training device is securely fastened to the racket regardless of size or shape. The device is fully adjustable so it can be used by players of all capabilities and strengths. The device does not injure the racket it is attached to. The device provides a quick means for attaching and removing from racket.

Although the description above contains many specificities, these should not be construed as limiting the scope of the invention but as merely providing illustrations of some of the presently preferred embodiments of this invention. For example, the weight can have other shapes, such as oval, trapezoidal, triangular, square, etc.

I claim:

1. A sports racket weighting device for use with a sports racket having a series of interwoven strings under tension, comprising:

a housing including a cavity;

at least one weight removably positioned in said cavity;

securing means for causing said housing to apply a securing force to said at least one weight to secure said at least one weight and said housing to the interwoven strings.

2. The device of claim 1, wherein said securing force secures said at least one weight to said housing within said cavity.

3. The device of claim 2, wherein said housing includes a first housing portion to be positioned on one side of the interwoven strings and a second housing portion to be positioned on an opposite side of the interwoven strings.

4. The device of claim 3, wherein said securing means includes a standoff connected to said housing and a threaded connection formed on said standoff for connecting said first and second housing portions.

5. The device of claim 4, wherein said securing means includes an aperture extending completely through said at least one weight, said standoff extending completely through said aperture.

6. The device of claim 3, wherein said housing includes an outer surface having a spherical shape.

7. The device of claim 2, wherein said securing means includes at least one abutment land formed on said housing for applying said securing force to said at least one weight.

8. The device of claim 1, wherein said at least one weight includes a plurality of weights, said cavity being sized to receive said plurality of weights on one side of the interwoven strings.

9. The device of claim 3, wherein said at least one weight includes a plurality of weights, said cavity being sized to receive said plurality of weights on both sides of the interwoven strings.

10. The device of claim 1, further including a protective means for protecting the strings from damage.

11. The device of claim 10, wherein said protection means includes at least one gasket positioned between said at least one weight and the interwoven strings so as to maintain a spaced distance between the strings and said at least one weight.

12. A sports racket weighting device for use with a sports racket having a series of interwoven strings under tension, comprising:

a first housing portion, a second housing portion connectable to said first housing portion and a housing cavity formed within said first and said second housing portions;

a plurality of weights positionable in said housing cavity, said housing cavity sized to receive said plurality of weights; and a securing means for securing said first and said second housing portions and said plurality of weights to the interwoven strings.

13. The device of claim 12, wherein said securing means includes a standoff connected to one of said first and said second housing portions and a threaded connection formed on said standoff for connecting said first and said second housing portions.

14. The device of claim 13, wherein said securing means includes an aperture extending completely through said plurality of weights, said standoff extending completely through said aperture.

15. The device of claim 12, wherein an outer surface of said first and said second housing portions has a spherical shape.

16. The device of claim 12, wherein said securing means includes at least one abutment land formed on at least one of said first and said second housing portions for applying a securing force to said plurality of weights.

17. The device of claim 12, further including a protection means for protecting the interwoven strings from damage.

18. The device of claim 17, wherein said protection means includes at least one gasket to be positioned between said plurality of weights and the interwoven strings so as to maintain a spaced distance between the strings and said plurality of weights.

* * * * *